US009830807B2

(12) United States Patent
Bass et al.

(10) Patent No.: US 9,830,807 B2
(45) Date of Patent: Nov. 28, 2017

(54) ACOUSTIC ALARM DETECTOR

(71) Applicant: Microsemi Semiconductor (U.S.) Inc., Austin, TX (US)

(72) Inventors: Eric Bass, Austin, TX (US); John Ward Logan, Austin, TX (US); Michael Gallagher, Langhorne, PA (US)

(73) Assignee: Microsemi Semiconductor (U.S.) Inc., Austin, TX (US)

( * ) Notice: Subject to any disclaimer, the term of this patent is extended or adjusted under 35 U.S.C. 154(b) by 0 days.

(21) Appl. No.: 15/203,819

(22) Filed: Jul. 7, 2016

(65) Prior Publication Data

US 2017/0011619 A1 Jan. 12, 2017

Related U.S. Application Data

(60) Provisional application No. 62/190,282, filed on Jul. 9, 2015.

(51) Int. Cl.

| | |
|---|---|
| ***G08B 29/00*** | (2006.01) |
| ***G08B 29/16*** | (2006.01) |
| ***G08B 1/08*** | (2006.01) |
| ***G08B 29/18*** | (2006.01) |
| ***G10L 25/51*** | (2013.01) |
| ***H04R 1/08*** | (2006.01) |

(52) U.S. Cl.

CPC ..... *G08B 29/16* (2013.01); *G08B 1/08* (2013.01); *G08B 29/185* (2013.01); *G10L 25/51* (2013.01); *H04R 1/08* (2013.01)

(58) Field of Classification Search

CPC ..... G08B 1/08; G08B 29/16; G08B 29/185; G10L 21/038; G10L 21/0364

See application file for complete search history.

(56) References Cited

U.S. PATENT DOCUMENTS 4,617,555 A * 10/1986 Sheiman ..... G08B 1/08 340/531
5,850,182 A * 12/1998 Schuler ..... G08B 17/12 250/339.15
6,920,194 B2 * 7/2005 Stopler ..... H04L 25/067 375/349

(Continued)

OTHER PUBLICATIONS

Ko-Chi Kuo, Ming-Jing Chen; 5 GHz Phase Locked Loop with Auto Band Selection; IEEE Asia Pacific Conference on Circuits and Systems, 2008, Nov. 30, 2008—pp. 550-553, IEEE, NY.

(Continued)

*Primary Examiner* — Firmin Backer
*Assistant Examiner* — Adnan Aziz
(74) *Attorney, Agent, or Firm* — Simon Kahn

(57) ABSTRACT

An audible alarm detector constituted of: a microphone generating an electronic signal from an audible signal; a phase locked loop locking onto a frequency component present in the generated electronic signal to output a demodulated signal; and a pattern detector for comparing the demodulated signal against each template of a known set of templates, each template representing a standard pulse stream, wherein upon detection that the demodulated signal matches one of the known templates, the audible alarm detector is arranged to output an alarm detected signal indicating a presence of one of the standard pulse streams.

15 Claims, 2 Drawing Sheets

(56) References Cited

U.S. PATENT DOCUMENTS

| | | | | |
|---|---|---|---|---|
| 7,015,807 | B2 | 3/2006 | Roby et al. | |
| 8,160,889 | B2 * | 4/2012 | Iser | G10L 21/038 381/1 |
| 8,269,625 | B2 | 9/2012 | Hoy et al. | |
| 2003/0103582 | A1 * | 6/2003 | Linsky | H04L 1/0045 375/327 |
| 2006/0071708 | A1 * | 4/2006 | Desbonnets | H03D 3/244 329/325 |
| 2008/0177532 | A1 * | 7/2008 | Greiss | G10L 21/0364 704/200.1 |
| 2008/0252368 | A1 * | 10/2008 | Spalink | H03D 3/241 329/325 |
| 2009/0176464 | A1 * | 7/2009 | Liang | H04B 1/0483 455/102 |
| 2010/0017205 | A1 * | 1/2010 | Visser | G10L 21/02 704/225 |
| 2013/0077797 | A1 * | 3/2013 | Hoy | G08B 3/10 381/56 |
| 2014/0254825 | A1 * | 9/2014 | Tahernezhadi | H04R 3/02 381/93 |
| 2015/0061861 | A1 | 3/2015 | Kuchta | |
| 2015/0381163 | A1 * | 12/2015 | Green | H03K 17/162 327/387 |

OTHER PUBLICATIONS

International Search Report for parallel PCT/US2016/041226 issued by the European Patent Office dated Sep. 27, 2016.

Written Opinion of the International Searching Authority for parallel PCT/US2016/041226 issued by the European Patent Office dated Sep. 27, 2016.

* cited by examiner

ACOUSTIC ALARM DETECTOR

FIELD OF THE INVENTION

This invention relates to the field of acoustic signal detection, and in particular to a method and apparatus for detecting specific acoustic signals indicating certain events, such as the presence of fire or carbon monoxide.

BACKGROUND OF THE INVENTION

In recent years audible fire alarm signals have standardized patterns, set by the American National Standards Institute (ANSI). For example, the pattern used for smoke alarms, in accordance with ANSI S3.41, is a three-pulse pattern, known as T3, which comprises three half second on pulses, each followed by a half second off period, the set followed by a one and a half second pause, with the cycle repeated for a minimum of 180 seconds. Carbon monoxide detectors use a similar pattern using four pulses, as defined by the National Fire Protection Association (NFPA) referred to as T4, where the signals consist of four 100 milliseconds on pulses, each followed by a 100 millisecond off period, the set followed by a 5 second pause. The alarms may use the older 3100 Hz sine wave or the newer 520 Hz square wave.

The purpose of the acoustic alarm is to alert personnel on site to evacuate, but it is desirable to automatically detect the existence of the acoustic alarm signal so that appropriate action can be taken, such as alerting off site personnel, without requiring integration with the smoke of carbon monoxide detector. Such acoustic detectors exist, but are limited in detection distance and noise suppression, and are prone to false alarms. Examples of prior art detection systems include U.S. Pat. Nos. 7,015,807 and 8,269,625, the entire contents of each of which are incorporated herein by reference.

SUMMARY OF THE INVENTION

According to an aspect of the present invention there is provided an audible alarm detector comprising: a microphone generating an electronic signal from an audible signal; a phase locked loop locking onto a frequency component present in the generated electronic signal to output a demodulated signal; and a pattern detector for comparing said demodulated signal against each template of a known set of templates, each template representing a standard pulse stream, wherein upon detection that said demodulated signal matches one of the known templates, said audible alarm detector is arranged to output an alarm detected signal indicating a presence of one of the standard pulse streams.

According to another aspect of the present invention there is provided a method of generating an alarm signal from and audible alarm, comprising: detecting an audible signal and generating an electronic signal; using a phase locked loop to lock onto a frequency component present in the generated electronic signal and output a demodulated signal; comparing said demodulated signal against each template of a known set of templates and producing a matching score, each template representing a standard pulse stream; and outputting an alarm detected signal indicating a presence of one of the standard pulse streams upon detection that said demodulated signal matches one of the known templates.

BRIEF DESCRIPTION OF THE DRAWINGS

The invention will now be described in more detail by way of example only, with reference to the accompanying drawings, in which.

DETAILED DESCRIPTION OF PREFERRED EMBODIMENTS

Figure 1:
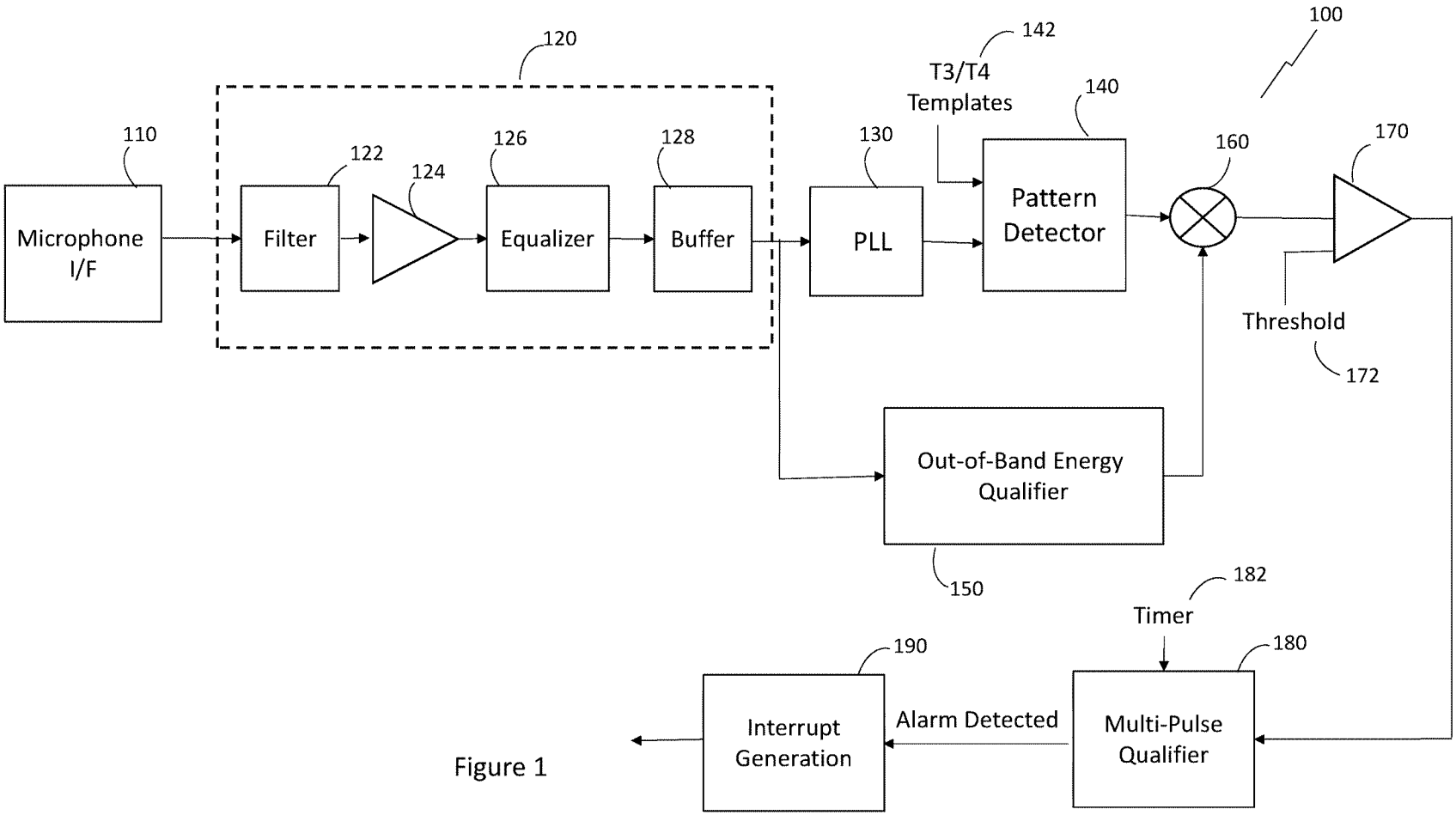
FIG. 1 is a system block diagram of an audible alarm detector in accordance with an embodiment of the invention.

FIG. 1 shows a block diagram showing the top level functionality of the audible alarm detector 100 in accordance with an embodiment of the invention. The detector 100 comprises a microphone interface 110 which detects an audible alert signal, as well as other ambient sounds. These audible alert signals can comprise an industry standard T3 pulse stream emitted by a smoke/fire detector and an industry standard T4 pulse stream emitted by a carbon monoxide alarm. The T3/T4 alarm may be of the older 3100 Hz sine wave alarm or the newer 520 Hz square wave alarm. The microphone interface 110 converts the sensed acoustic energy from the audible alert signals into electromagnetic energy. The microphone interface can include a digital microphone which can comprise an analog-to-digital converter. The invention is not limited to digital microphones, however, and an analog microphone could also be implemented. An analog-to-digital converter would preferably be provided to convert the audible alert signal into a digital signal. The detected signal is preferably sampled at 8 KHz or 16 KHz for conversion into a digital signal. Next the digital signal outputted from the microphone interface 110 is input into front end signal conditioning block 120. The front end signal conditioning block 120 removes constant (i.e. DC) and low frequency components from the digital signal. The front end signal conditioning block 20 also levels the frequency response and amplifies the digital signal. The front end signal conditioning block 120 can comprise, but is not limited to, filters such as high-pass filters 122 for removing DC and low frequency components. The front end signal conditioning block 120 can also comprise amplifier 124 for signal amplification. The amplified signal can then be passed through an equalizer 126 to stabilize or flatten the frequency response. The equalized signal is then stored in buffer 128. The conditioned digital signal is then output from the front end signal conditioning block 120 and input to digital phase-locked loop (PLL) 130. The PLL 130 is used for pulse demodulation. The PLL 130 locks onto the largest fundamental frequency present within either the 520 Hz or 3100 Hz band which simplifies frequency tuning compared to other methods such as using filter banks or Fast Fourier Transform (FFT). Since each PLL will lock onto a particular frequency, at least two PLLs would be required for the detection of 520 HZ and the 3100 Hz carrier frequencies. The T3 and T4 signals each have a carrier frequency of 3100 Hz which can vary by +/−10%. Similarly, at 520 Hz, the carrier frequency can vary by +/−10%. As such, the PLL must be able to lock to those range frequencies. The largest fundamental frequency corresponds to the frequency having the strongest signal strength or amplitude. The output of the PLL 130 is the baseband demodulated pulse corresponding to the envelope of the in band modulated signal. According to an embodiment of the invention, the PLL 130 uses continuous frequency domain sampling for demodulating the 520 Hz or 3100 Hz carrier frequency which avoids sampling tied to expected input duration. This is in contrast to certain prior art systems such as the discrete sampling in the Fast Fourier transform (FFT) method used in U.S. Pat. No. 7,015,807 where quantization errors and aliasing may be of concern. Furthermore, the use of a PLL, in place of FFT is advantageous since demodulation is performed without requiring any a-priori information since the PLL 130 locks onto the fundamental frequency having the strongest signal strength. After demodulation, the signal is input into pattern detector 140. In the pattern detector 140, the demodulated pulse output from the PLL 130 is decoded to determine if the target T3 and/or T4 pulse stream exists. Detection of the target T3 and/or T4 pulse stream is performed by correlation against a known set of templates of the T3/T4 pulse streams 142. In some embodiments of the present invention, pattern detection can be achieved using a correlator such as a matched filter. The pattern detector 140 is not limited to a correlator, and other implementations may be used. In the present embodiment, the set of T3/T4 templates 142 are stored in on-chip memory (not shown). In other embodiments, an external memory may be used to store a wider array of templates. The output of the pattern detector 140 is a matching score which is a numerical representation of the strength of the match between the output of the PLL 130 and the T3/T4 templates.

In some cases, a rich signal (often music or a similarly pulsed non T3 alarm) can cause a false positive detection. To keep those situations from causing a false trigger, the energy out of band may be tested in accordance with an embodiment of the invention. In this embodiment, the signal power including the total power and the power in the desired band (3100 Hz and/or 520 Hz) is monitored in parallel to the PLL 130 and pattern detector 140 by out-of-band energy qualifier 150. A wideband-to-narrowband ratio is determined and output from out-of-band energy qualifier 150. The ratio represents a value between 0 and 1 and is used to adjust the output of the pattern detector 140. In a situation where there is little wideband noise, the output of out-of-band energy qualifier 150 will be closer to 1. Conversely, in a situation where a lot of wideband noise is present, the output of out-of-band energy qualifier 150 will be closer to 0 and thus will significantly lower the matching score output from pattern detector 140. This has the effect of requiring the detected signal to be very exact if there is a lot of out of band noise. The output of the out-of-band energy qualifier 150 is input into multiplier 160 along with the output of the pattern detector 140. The output of multiplier 160 represents an adjusted output of the pattern detector in view of background noise or a non T3/T4 alarm.

The output of multiplier 160 is input into comparator 170. The comparator 170 compares the output of the pattern detector 140 with a threshold value 172 to qualify the result of the pattern detector 140. If the output of the pattern detector 140 meets and/or exceeds the threshold value 172, the audible alert signal detected by microphone interface 110 is determined to be an actual T3/T4 pulse stream and the comparator 170 outputs an active high signal. However, if the output of the pattern detector 140 is lower than the threshold value 172, the audible alert signal is determined not to be a T3/T4 pulse stream and the comparator 170 outputs an active low signal.

In certain embodiments, after a single T3/T4 alarm period is detected at the output of comparator 170 by an active high signal, the alarm can be further qualified by checking if subsequent alarms are present by multi-pulse qualifier 180. For example, in some embodiments of the invention, N audible alarms must be detected within a predetermined time window determined by timer 182 before outputting an alarm detected signal. In the event that only a single alarm period is detected, with no subsequent alarm period within the predetermined time window, the multi-pulse qualifier 180 does not assert an alarm detected signal. This adds to the general robustness of the alarm detection accuracy. This process looks to see if more than a predetermined number of frames in a given interval resulted in assertion of an active high signal by comparator 170. Since the output of the pattern detector 140, before comparator 170, is a score corresponding to the probability a T3/T4 alarm was detected, these scores may be summed over time to provide a continuous multiple pulse qualification. If so, the host/user is alerted that a T3/T4 alarm was detected responsive to an output alarm detected signal from the multi-pulse qualifier 180. In block 190, an interrupt or a notification is generated and output, responsive to output alarm detected signal from the multi-pulse qualifier 180, preferably to a host system so that an action can be taken. The interrupt or notification is thus generated responsive to the asserted signal at the output of comparator 170. In certain embodiments neither multi-pulse qualifier 180 nor out-of band energy qualifier 150 are provided. Alternately, in other embodiments of the present invention, the output of pattern detector 140, appropriately buffered or amplified if required, is used as the interrupt or notification output, without requiring comparator 170, or multi-pulse qualifier 180.

Figure 2:
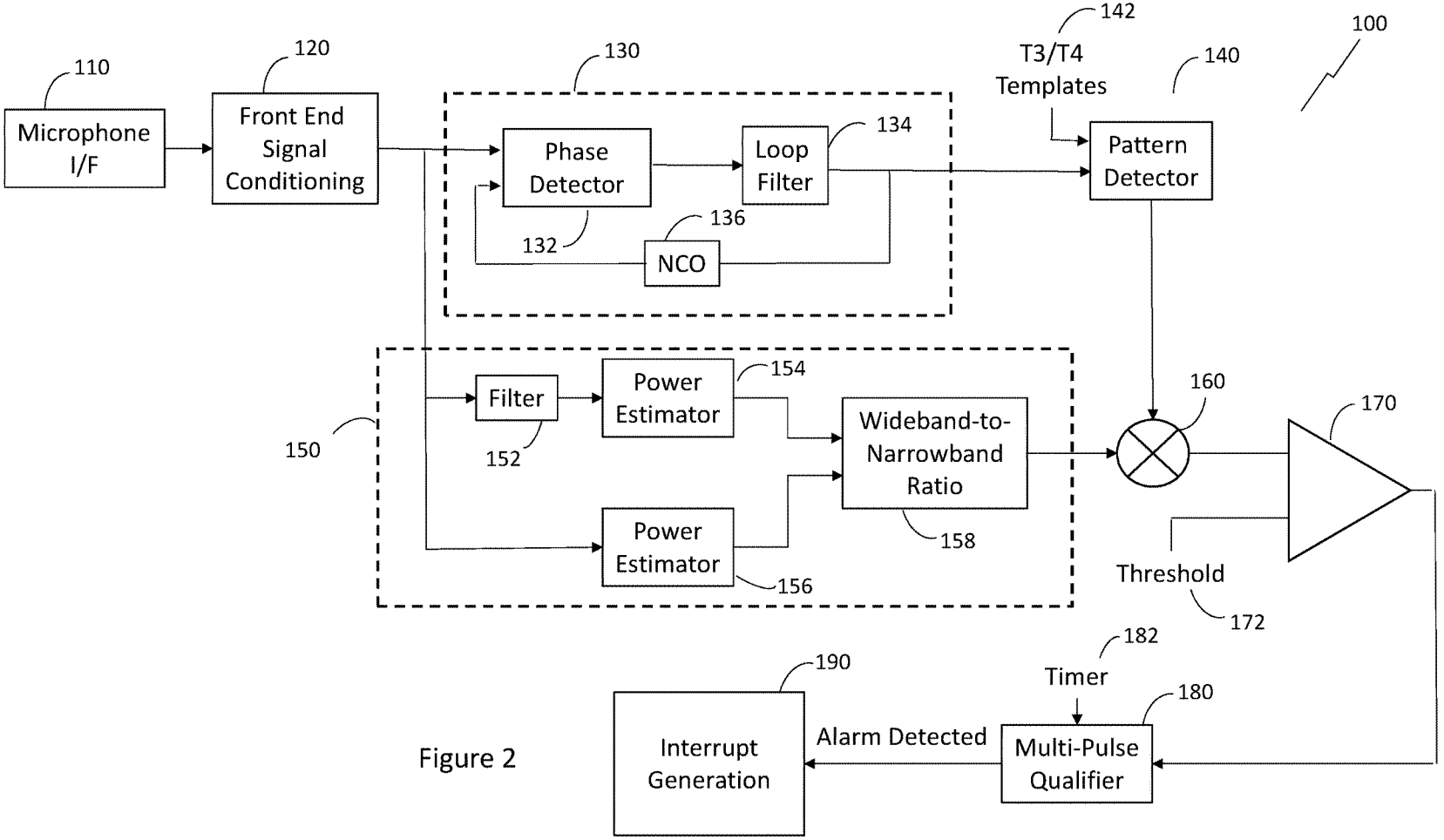
FIG. 2 is a system block diagram of the audible alarm detector of FIG. 1 showing details of an embodiment of the phase-locked loop and an embodiment of the out-of-band energy qualifier.

FIG. 2 shows the detector 100 of FIG. 1, with details of the PLL 130 and out-of-band energy qualifier 150. As shown in FIG. 2, microphone interface 110 is connected to front end signal conditioning block 120, the details of which are shown in FIG. 1. The conditioned signal then is input to PLL 130 and out-of-band energy qualifier 150. The structure of the PLL 130 generally comprises a phase detector 132, a loop filter 134 and an oscillator 136, such as a numerically-controlled oscillator (NCO) or a voltage-controlled oscillator. Other oscillator configurations can also be implemented. The conditioned signal is input into the phase detector 132 along with the feedback from the oscillator 136. The phase detector can be thought of as a multiplier, such that the output of the phase detector contains both sum and difference frequency components. The loop filter 134 removes the high frequency components and the output from the loop filter 134 is the demodulated signal. This demodulated signal output from loop filter 134 is then fed into pattern detector 140. In parallel to the PLL, the out-of-band energy qualifier 150 functions to qualify the detected audible alert signal to avoid false positive detection of the T3/T4 stream due to background noise or a non T3/T4 alarm. Out-of-band energy qualifier comprises filter 152, which is generally a band-pass filter to narrow the band of interest which can either be the 520 Hz band or the 3100 Hz band. Power estimator 154 is then used to determine the power of the band of interest. Concurrently, power estimator 156 is used to determine a total power of the entire frequency band of the conditioned signal which corresponds generally to the frequency band of the detected audible alert signal. In block 158, the wideband-to-narrowband ratio of the output of power estimator 154 (power of the band of interest, or narrowband) to the output of power estimator 156 (power of entire spectrum of detected audible alert signal) is determined. The result is a value which ranges between 0 and 1 and is used as an input to multiplier 160 to adjust the output or matching score of the pattern detector 140 as described above.

It should be appreciated by those skilled in the art that any block diagrams herein represent conceptual views of illustrative circuitry embodying the principles of the invention. For example, a processor may be provided through the use of dedicated hardware as well as hardware capable of executing software in association with appropriate software. When provided by a processor, the functions may be provided by a single dedicated processor, by a single shared processor, or by a plurality of individual processors, some of which may be shared. Moreover, explicit use of the term "processor" should not be construed to refer exclusively to hardware capable of executing software, and may implicitly include, without limitation, digital signal processor (DSP) hardware, network processor, application specific integrated circuit (ASIC), field programmable gate array (FPGA), read only memory (ROM) for storing software, random access memory (RAM), and non-volatile storage. Other hardware, conventional and/or custom, may also be included. The functional blocks or modules illustrated herein may in practice be implemented in hardware or software running on a suitable processor.

The invention claimed is:

1. An audible alarm detector for detecting one or more standard pulse streams of a pulsed audible tone, comprising:

a microphone generating an electronic signal from an audible signal;

a phase locked loop for locking onto a frequency component present in the generated electronic signal and including a loop filter generating a baseband demodulated pulse stream; and a pattern detector coupled to an output of said loop filter for comparing said demodulated baseband pulse stream against a known set of templates, each template representing one of said standard pulse streams, and wherein said audible alarm detector outputs an alarm detected signal indicating a presence of one of said standard pulse streams in said audible signal upon detection that said baseband demodulated pulse stream matches one of the known templates.

2. The audible alarm detector as claimed in claim 1, wherein said frequency component is a fundamental frequency present in the pulsed audible tone.

3. The audible alarm detector as claimed in claim 1, further comprising a comparator to compare an output of the pattern detector with a threshold, and wherein, when said output of the pattern detector exceeds said threshold, said comparator is arranged to output an active high signal, said alarm detected signal being responsive to said comparator active high output signal.

4. The audible alarm detector as claimed in claim 3, further comprising:

an out-of-band energy qualifier which determines a ratio of the power of a portion of said audible signal falling within an expected audible alarm band to a total power of said audible signal; and a multiplier arranged to adjust an output of the pattern detector by the output of the out-of-band energy qualifier, said adjusted output of the pattern detector being fed to the input of the comparator.

5. The audible alarm detector as claimed in claim 4, further comprising a multi-pulse qualifier arranged to output said alarm detected signal responsive to a plurality of comparator active high output signals within a predetermined time window.

6. The audible alarm detector as claimed in claim 1, further comprising a multi-pulse qualifier, wherein said multi-pulse qualifier is arranged to output said alarm detected signal only when a predetermined number of audible alarms are detected by said multi-pulse qualifier within a given time window.

7. The audible alarm detector of claim 1, wherein said phase locked loop is a digital phase locked loop responsive to a sampled version of said audible signal.

8. An audible alarm detector, comprising:

a microphone generating an electronic signal from an audible signal;

a phase locked loop locking onto a frequency component present in the generated electronic signal to output a baseband demodulated signal;

a pattern detector for comparing said baseband demodulated signal against each template of a known set of templates, each template representing a standard pulse stream;

wherein upon detection that said demodulated signal matches one of the known templates, said audible alarm detector is arranged to output an alarm detected signal indicating a presence of one of the standard pulse streams; and said audible alarm detector further comprising:

an out-of-band energy qualifier arranged to determine a ratio of the power of a portion of said audible signals within an expected audible alarm band to a total power of said audible signal; and a multiplier arranged to adjust an output of the pattern detector by the output of the out-of-band energy qualifier.

9. A method of generating an alarm signal from an audible alarm comprising one or more standard pulse streams of pulsed audible tones, said method comprising:

detecting an audible signal and generating an electronic signal;

using a phase locked loop to lock onto a frequency component present in the generated electronic signal, said phase locked loop including a loop filter outputting a baseband demodulated pulse stream;

comparing said baseband demodulated pulse stream against a known set of templates and producing a matching score, each template representing a said standard pulse stream; and outputting an alarm detected signal indicating a presence of one of the standard pulse streams in said audible signal upon detection that said baseband demodulated pulse stream matches one of the known templates.

10. The method as claimed in claim 9, wherein said frequency component is a fundamental frequency present in the audible alarm.

11. The method as claimed in claim 9, further comprising comparing the matching score with a threshold, wherein, when said matching score exceeds said threshold, an active high signal is output, and wherein said alarm detected signal is responsive to said active high signal.

12. The method as claimed in claim 11, further comprising:

determining a ratio of the power of the audible signal within an expected audible alarm band to a total power of said audible signal; and adjusting said matching score based on said ratio.

13. The method as claimed in claim 12, further comprising outputting said alarm detected signal responsive to a plurality of said active high signals within a predetermined time window.

14. The method as claimed in claim 9, further comprising:

determining a ratio of the power of the audible signal within an expected audible alarm band to a total power of said audible signal; and adjusting said matching score based on said ratio.

15. The method as claimed in claim 11, further comprising outputting said alarm detected signal in response to detection of a plurality of said active high signals within a predetermined time window.

* * * * *